US008225529B2

(12) United States Patent
Simms

(10) Patent No.: US 8,225,529 B2
(45) Date of Patent: Jul. 24, 2012

(54) OVERSHOE FOR ATHLETIC SHOES

(75) Inventor: Suzanne Simms, San Mateo, CA (US)

(73) Assignee: Suzanne Simms, San Mateo, CA (US)

( * ) Notice: Subject to any disclaimer, the term of this patent is extended or adjusted under 35 U.S.C. 154(b) by 626 days.

(21) Appl. No.: 12/286,419

(22) Filed: Sep. 29, 2008

(65) Prior Publication Data

US 2010/0077638 A1 Apr. 1, 2010

(51) Int. Cl.
*A43B 5/00* (2006.01)

(52) U.S. Cl. ..... 36/7.1 R; 36/135; 36/136

(58) Field of Classification Search ..... 36/136, 36/135, 7.1 R, 127, 113, 7.3, 7.5, 7.6
See application file for complete search history.

(56) References Cited

U.S. PATENT DOCUMENTS

| | | | | | |
|---|---|---|---|---|---|
| D11,821 | S | | 6/1880 | Ensign | |
| D90,037 | S | | 5/1933 | Waters | |
| D127,991 | S | | 7/1941 | Feinberg | |
| 2,436,234 | A | | 2/1948 | Stein | |
| 2,860,425 | A | | 11/1958 | Jackson | |
| 2,958,963 | A | * | 11/1960 | Lougheed | 36/7.5 |
| 3,313,047 | A | * | 4/1967 | Svien | 36/7.3 |
| 3,486,248 | A | | 12/1969 | Iverson et al. | |
| 3,559,309 | A | | 2/1971 | Taylor | |
| 3,616,552 | A | | 11/1971 | Kniffin | |
| 3,621,592 | A | | 11/1971 | Goldmerstein | |
| 3,643,352 | A | | 2/1972 | Adair | |
| 3,763,578 | A | | 10/1973 | Chadwell | |
| 3,858,336 | A | * | 1/1975 | Brown | 36/135 |
| D249,908 | S | | 10/1978 | Meinhart | |
| 4,122,577 | A | * | 10/1978 | Catania | 15/160 |
| 4,246,707 | A | | 1/1981 | Pedersen | |
| 4,326,345 | A | * | 4/1982 | Sbicca | 36/135 |
| 4,350,457 | A | * | 9/1982 | Carnahan | 401/11 |
| 4,693,019 | A | * | 9/1987 | Kim | 36/7.3 |
| 4,872,273 | A | * | 10/1989 | Smeed | 36/135 |
| 5,056,240 | A | | 10/1991 | Sherrill | |
| 5,070,631 | A | * | 12/1991 | Fenton | 36/127 |
| 5,315,767 | A | * | 5/1994 | Bradbury | 36/7.1 R |
| 5,425,186 | A | * | 6/1995 | Hoyt | 36/97 |
| 5,548,910 | A | * | 8/1996 | Klingseis | 36/135 |
| D385,092 | S | | 10/1997 | Holden | |
| D386,592 | S | | 11/1997 | Lucas | |
| 5,809,669 | A | * | 9/1998 | Hage et al. | 36/127 |
| D399,041 | S | | 10/1998 | Teague | |
| 5,930,920 | A | * | 8/1999 | Arnold | 36/132 |
| 5,979,008 | A | * | 11/1999 | Gordon | 15/227 |
| 6,128,801 | A | * | 10/2000 | Adzick et al. | 15/210.1 |
| D437,676 | S | | 2/2001 | Ferrer | |
| D446,912 | S | | 8/2001 | Cockrell | |
| 6,374,449 | B1 | | 4/2002 | Jolly | |

(Continued)

OTHER PUBLICATIONS

PCT Notification of Transmittal of the International Search Report and the Written Opinion of the International Searching Authority, or the Declaration for PCT Counterpart Application No. PCT/US2009/057906, 8 pages, (Nov. 17, 2009).

*Primary Examiner* — Marie Patterson
(74) *Attorney, Agent, or Firm* — Blakely, Sokoloff, Taylor & Zafman LLP

(57) ABSTRACT

A lightweight yet durable, self-adhering, protective overshoe with integrated cleaning bosses providing a more efficient and complete method for athletic cleat or boot cleaning, maintenance, handling and storage.

12 Claims, 8 Drawing Sheets

U.S. PATENT DOCUMENTS

| | | | | |
|---|---|---|---|---|
| 6,393,648 | B1 | 5/2002 | Reynolds | |
| 6,584,704 | B2 | 7/2003 | March | |
| 6,732,397 | B2 * | 5/2004 | Thompson | 15/160 |
| 7,188,438 | B1 | 3/2007 | Bowen | |
| D548,430 | S | 8/2007 | Hulcy | |
| 7,313,842 | B1 * | 1/2008 | Preciado | 15/227 |
| 2003/0131500 | A1 * | 7/2003 | Kline et al. | 36/127 |
| 2004/0074113 | A1 | 4/2004 | Kim et al. | |
| 2005/0022430 | A1 | 2/2005 | Terry | |
| 2007/0006490 | A1 | 1/2007 | Kay | |
| 2007/0113424 | A1 | 5/2007 | Bell | |

* cited by examiner

OVERSHOE FOR ATHLETIC SHOES

FIELD OF THE INVENTION

The present invention pertains to overshoes.

PRIOR ART

During normal shoe use and in many outdoor sports such as soccer, golf, lacrosse, baseball, football, track and mountain climbing, for example, where cleated shoes are used; the sole of the shoe attracts and retains mud, dirt, grass, moisture and debris during play. Due to the dirty nature of cleated shoes, there are numerous problems associated with the use and storage of such shoes. One problem is that cleated shoes will be ineffective for the next round of play if the mud and debris dries and is not removed. Consequently, the most common methods a participant has to deal with these issues is to remove the sport shoes and either bang them together or scrape them against an object like a stone, stick or curb to remove the debris. This is very messy and the player is left to stand outdoors barefoot whilst extracting the debris or one must carry a separate cleaning brush to insure the sport shoes are maintained properly. This is cumbersome and inefficient.

Alternatively, when the sport play is finished, some players choose to remove the cleated shoes and throw them into a sport bag or car until needed again, causing dirt and debris to litter the chosen storage space. Usually, a second pair of clean shoes is donned so that the drive home is safe and so that the car or other clean environment that the wearer steps into is not sullied by the retained debris and mud, yet the problem of removing the retained debris still is not addressed through this activity.

Another problem is that these activities take place outside and, if the weather conditions are bad (e.g. rainy or thunderstorms/lightening), or if practice or play ends after sundown, there is a need to have quick mobility and walking on abrasive surfaces with cleats on or changing shoes at this point is not safe or ideal.

Furthermore, there is also the problem of determining the best site to don the sport or cleated shoes. Due to the dirty nature of the outdoor shoe and the need to insure that cleated shoes are not worn on abrasive surfaces to prevent premature cleat wear, many players put their sport shoes on outside, at the site of play. Many sports enthusiasts would prefer to don the cleated shoes in the comfort of their home but, because the shoes are dirty and the cleats can scratch hardwood and other walking surfaces, this luxury is not afforded.

Accordingly, there exists a need to have a single article that can not only cover and protect any cleated or athletic type shoe, regardless of shoe brand or cleat configuration, but can also integrate the necessary and important steps of cleaning, ventilating and storing the athletic shoe to provide clean, quick mobility and efficiency in using and maintaining these types of shoes.

SUMMARY OF THE INVENTION

An overshoe for engaging an athletic shoe and for providing an integral cleaning tool for cleaning the athletic shoe is disclosed. The overshoe includes a sole having an outsole and insole. An upper is connected with the sole for allowing the overshoe to engage the athletic shoe. In one embodiment, at least one boss extends upwardly from the insole at the heal section such that the boss can be used to clean the bottom of the athletic shoe. The overshoe is flexible so that the upper can be rolled back allowing the boss to be used for cleaning, for example, around the cleats of the athletic shoe. The bosses are sized to fit in a non-interfering relationship to the cleats on an athletic shoe when the overshoe is worn over the athletic shoe.

The present invention seeks to provide a complete solution by addressing the inevitable problem of cleaning the shoe so that it can be covered, eliminating the need to keep a separate cleaning object or alternative footwear to change into, and because air holes can be included in the device, the overshoe can remain on the cleated shoe and be stored while the inner cleated shoe dries. Additionally, additional aids in the drying process such as a cloth covered bag filled with desiccant to speed the drying process while maintaining the original shoe shape without shrinkage or the need to fill the shoe with newspaper as many sport shoe users do, may be used. Furthermore, some shoes such as those with leather uppers, should be polished in order to maintain the longevity, form and aesthetics of the shoe. Shoe leather and other conditioners are available so that the user can polish the shoe. Because the described overshoe has a self adhering and snug fit, it allows for a pre-cover that is pre-impregnated with conditioner to be donned before the outer shoe cover. While the user is walking with the two covers over the inner shoe, the conditioning cover is rubbed into the sides of the shoe and provides an automated method for conditioning the inner shoe.

BRIEF DESCRIPTION OF THE DRAWINGS

FIG. 5 is a cross-sectional, elevation view of the overshoe of FIG. 1 illustrating the bosses engaging cleats from an athletic shoe, or the like.

DETAILED DESCRIPTION

Figure 1:
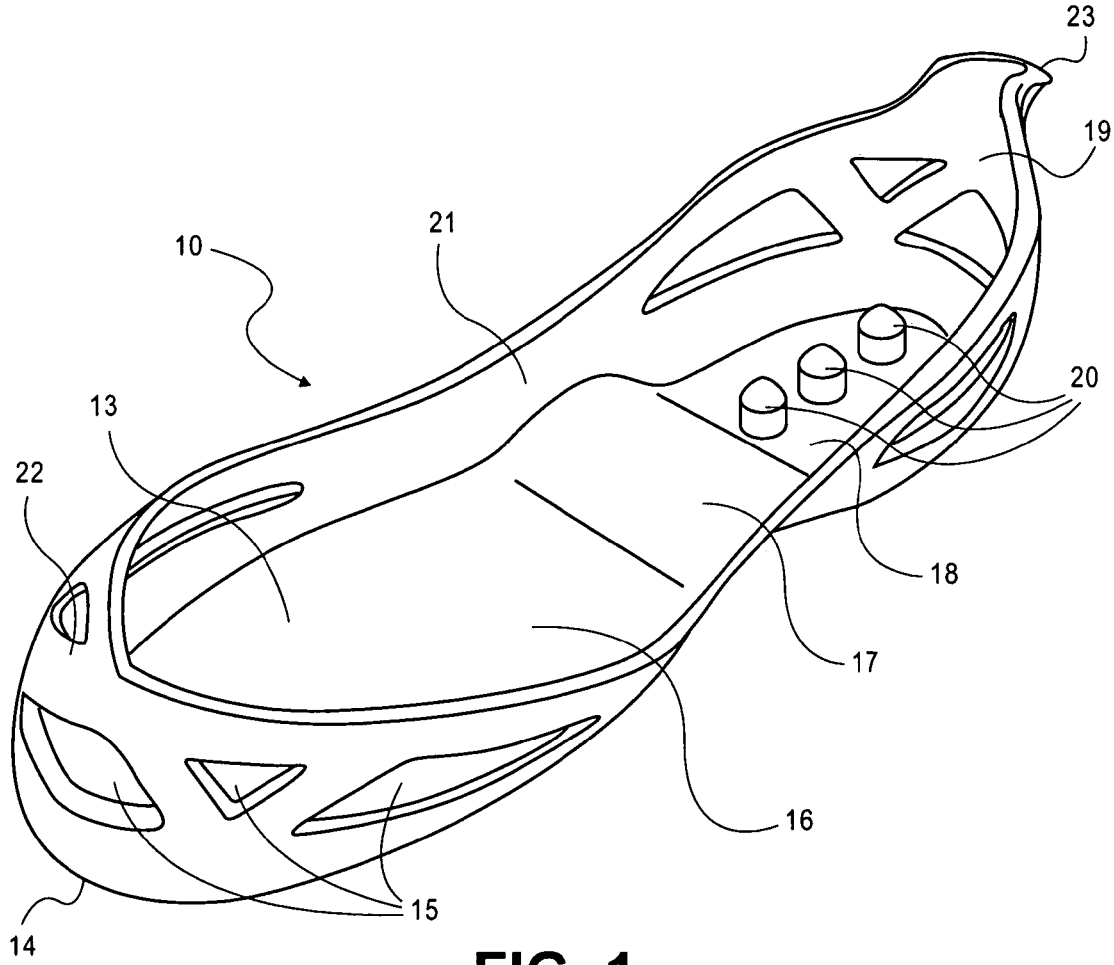
FIG. 1 is a perspective view of one embodiment of the invented overshoe. It shows the insole, the overshoe upper, and bosses or protrusions which extend into the interior area of the insole at the heel area. The bosses and a hook-shaped protrusion on the rear of the overshoe are cleaning tools.

An overshoe is disclosed for engaging an athletic shoe and for providing a cleaning tool integral with the overshoe for cleaning the athletic shoe. In the following description numerous specific details are set forth such as specific dimensions. It will be obvious to one skilled in the art that the present invention may be practiced without these specific details. In other instances well-known techniques, such as those for fabricated molded shoes and the like, are not described in order not to unnecessarily obscure the present invention.

Embodiments of the present invention provide a lightweight yet durable overshoe with integrated cleaning bosses to allow the player to easily remove the mud and grass from the athletic shoe at the site of play, while the cleated shoes remain on the players feet for ease of use, and then allow the player to don the protective overshoe to insure that any small pieces of dirt and debris fall inside the overshoe and to allow mobility without degradation of the cleats or the external environment. Additionally, embodiments of the present invention insure that the inner sport shoe is allowed to dry properly through strategically placed cutaway holes that serve to both ventilate and add gripping places for easy application of the overshoe before or after cleaning to provide the user with quick, clean, mobility after or prior to sport play.

The multipurpose overshoe comprises an abrasion and tear resistant outsole integral with the insole and upper, which contain strategically placed bosses to allow the cleated sport shoe to be cleaned of lodged mud and debris before or after donning the shoe for protective and mobility purposes. The overshoe has a low profile, which allows the user to put on or take off the inner cleated athletic shoe or boot without being required to remove the overshoe for simplified handling, storage, and usability. Additionally, the overshoe upper has ventilation grips, in order to insure airflow to the cleated shoe, to aid in gripping during application or removal of overshoe, and to allow the device to be turned inside out or to be easily manipulated to access cleaning bosses placed in or on the frame of the overshoe for cleaning purposes. The overshoe can be translucent or colored with sport logos or patterns and may include separate adornments that can be inserted into the ventilation holes to individualize and enhance the appearance of the overshoe.

FIGS. 1-8 illustrate one preferred embodiment of a protective overshoe 10 with integrated cleaning protrusions or bosses 20 extending into the interior of the overshoe from the heel region. The overshoe 10 is sized to fit over a cleated athletic shoe or boot 12 (FIG. 8) while the cleated shoe or boot (henceforth called cleated shoe) is worn by the wearer. The overshoe 10 may be of different sizes such as small, medium and large to encompass most junior's, men's and women's cleat sizes but may include extra small or extra large. The overshoe in one embodiment is devised so that the left and right feet are identical and will accommodate different brand and spike/cleat 11 (FIG. 7) configurations of the cleated shoes 12. The overshoe 10 may be made of any material such as neoprene, reinforced rubber, polyurethane, various other thermal plastic elastomers or any suitable material as a single member and can be manufactured through cast or injection molding techniques or through other means as will be apparent to those skilled in the art.

In one embodiment the overshoe 10 is molded in one piece from a polyurethane product—Vitaflex 40, from Smooth-On Corporation, 2000 Saint John Street, Easton, Pa., 18042. The material of choice for mass manufacturing could have similar properties of elasticity, abrasion resistance, tear strength and durability to withstand the pressure and tearing of the internal shoe's spikes/cleats 11 while walking or running. Vitaflex 40 has a durometer of 40 Shore A with a tear strength of 82 pli and elongation at break of 660%, which is sufficient for walking and running on pavement, up and down hills, during testing with no breaking, tearing or loss of fit.

Accordingly, the overshoe 10 has the general shape of a cleated shoe 12 and from top view, as seen in FIG. 1, comprises an insole 13, having of a sole section 16, shank 17, and heel section 18 with integrated cleaning bosses 20, an outsole 14 and an integral upper 21. Ventilation grips 15 are disposed through the toe region 22 and upright heel region 19. An alternate cleaning boss 23 extends from the upper part of the region 19.

Figure 2:
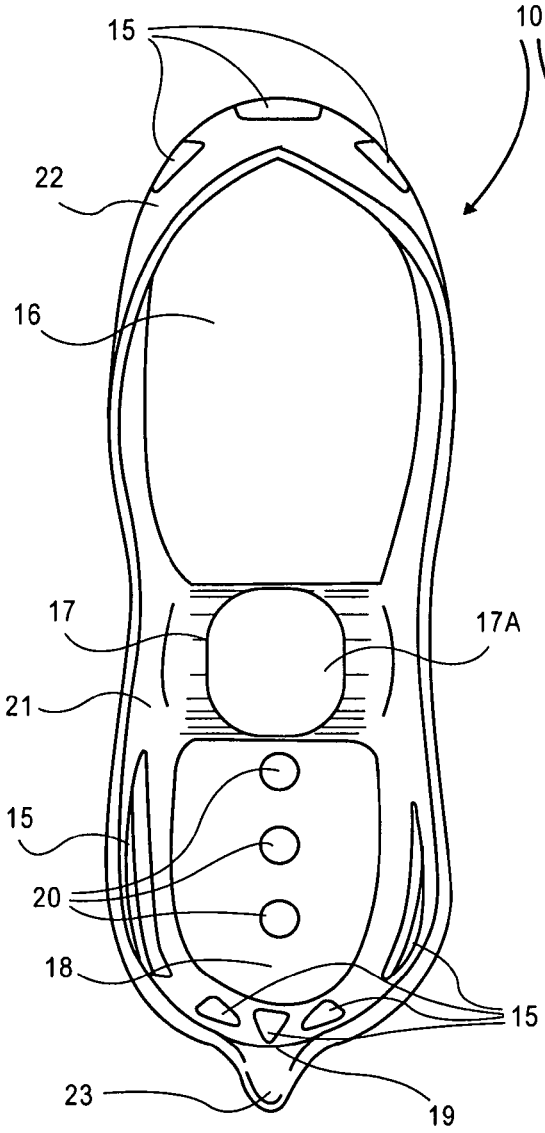
FIG. 2 is a plan view showing the overshoe of FIG. 1.
Figure 3:
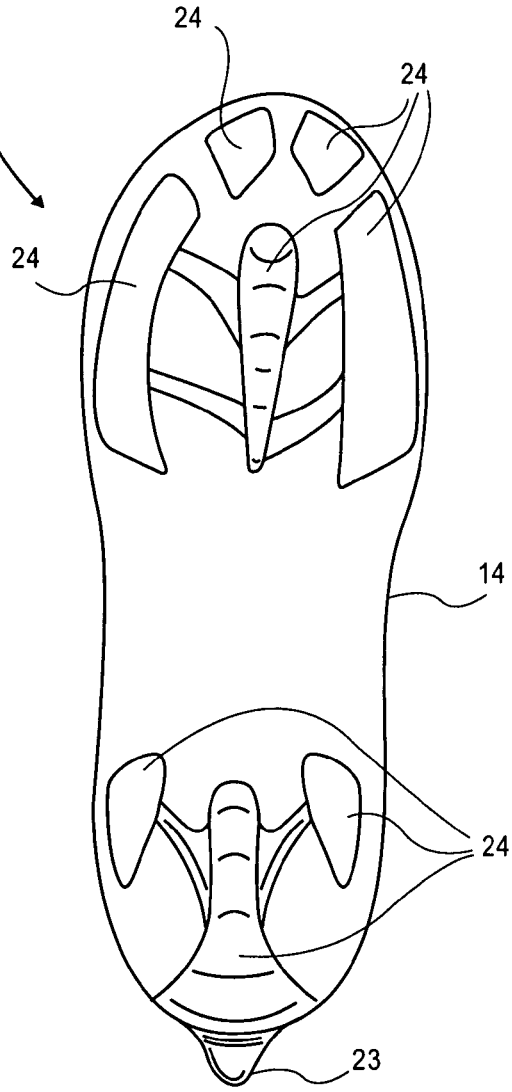
FIG. 3 is a bottom view of the overshoe of FIGS. 1 and 2.

Referring to FIGS. 2 and 3, from the plan view the sole section 16 and heel section 18 areas are recessed (to a depth of 2 cm in the one embodiment) to insure that the spikes/cleats 11 on the cleated shoe 12 are completely enclosed when the overshoe 10 is donned to prevent leakage of any residual small pieces of mud, dirt, or debris.

In any overshoe, the sole and heel parts are subjected to the greatest wear due to walking, while the shank part there between, being set upwardly to accommodate the arched shank in the inner shoe, receives less wear. For cleated overshoes 12, the additional pressure and stress of pointed spikes/cleats 11 bearing down on the insole of the overshoe adds an even greater stress. For these reasons, the ground contacting areas of the sole section 16 and heel section 18 are made of a greater thickness than the shank 17. In one embodiment, the sole section or socket 16 is 0.7 cm thick while the shank 17 is approximately 0.4 cm thick at its center. The thinned shank 17 provides front to back stretch allowing for elongation to accommodate multiple shoe sizes in the small, medium, large format as described previously. Additionally, the shank 17 is channeled (see channel 17A of FIG. 2) so that the middle of the shank is thinner than the side areas for two reasons. First, some cleated shoes 12 like those for soccer as an example, have an additional spike/cleat 11 that extends into the shank 17 area along the outer edge and therefore the side edges of the shank 17 need to be of a thickness to insure that the spike/cleat 11 does not tear through during walking. Second, the thinner mid region of the shank 17 tends to pull the sides in and around the cleated shoe 12 when stretched, thereby providing a snug fit with no bulging.

While in the described embodiments the bosses 20 are shown in the heel section 18, they may be placed elsewhere in the overshoe interior. In general, they should be in a non-interfering location with respect to the cleats.

The heel section 18 is also graded but in an opposite fashion, as compared to the shank, so that the center line is thicker (approximately 0.8 cm in one embodiment) than the outer edges (approximately 0.6 cm for this embodiment) to allow inversion of the heel area in order to access the cleaning bosses 20. This heel section 18 may include at least one integrated cleat cleaning boss 20 but, ideally, may contain 3 cleaning bosses 20, positioned along the center line of the heel section 18 or in any area where the majority of cleated shoes 12 are ideally free from cleats 11. In this embodiment, the cleat cleaning bosses 20 are made with a height of approximately 1 cm and spaced apart approximately 1 cm from each other, so as to fit in an interlocking fashion with said cleats 11 on said cleated shoes 12, (which are of the approximate same dimensions) for cleaning purposes, prior to or after donning of said overshoe 10 when inverted and exposed as in FIG. 7.

Figure 4:
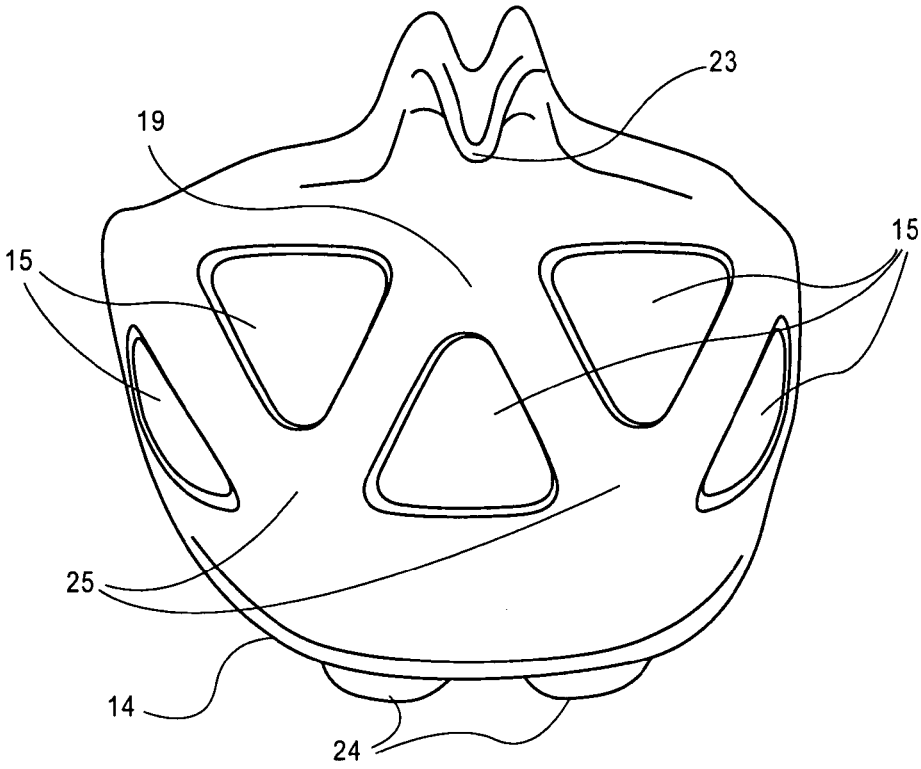
FIG. 4 is a rear view of the overshoe of FIGS. 1, 2 and 3.
Figure 8:
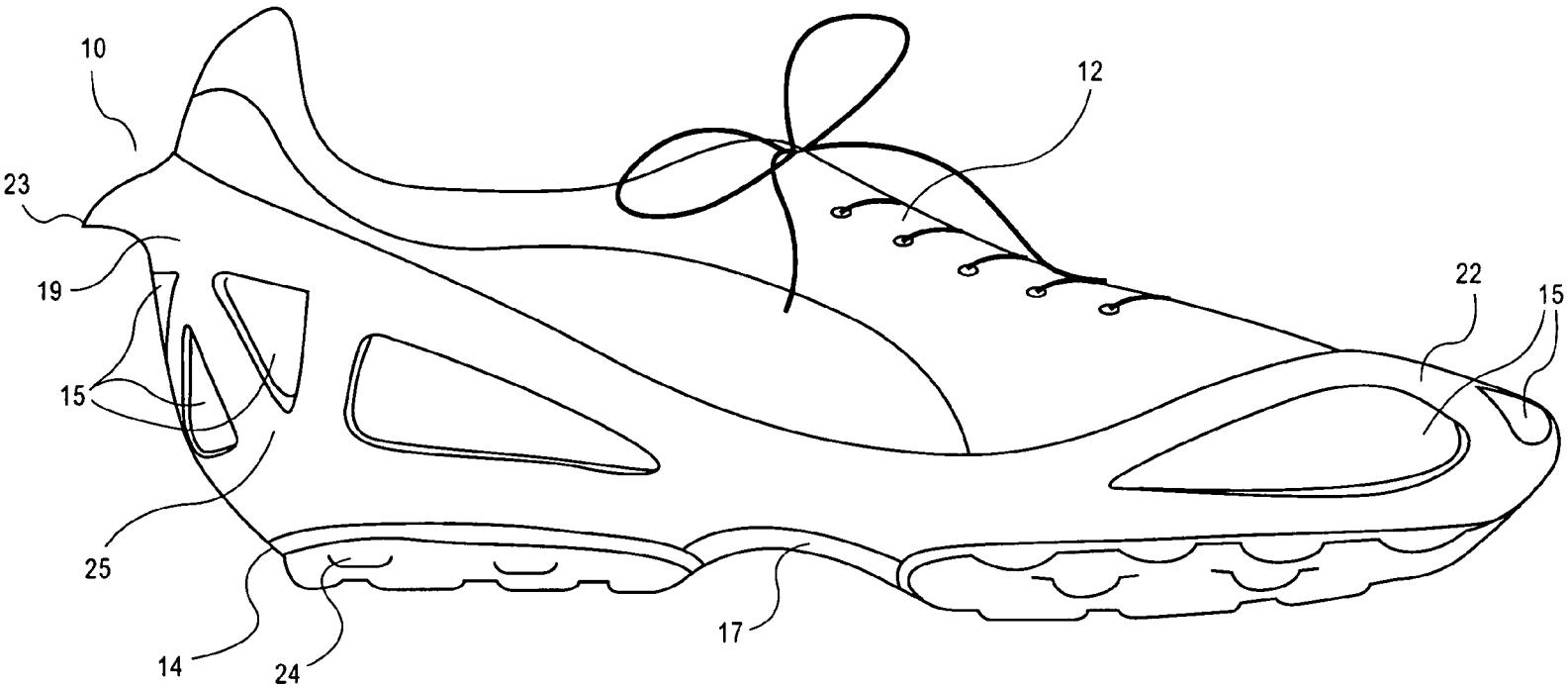
FIG. 8 illustrates the overshoe of FIG. 1 engaging an athletic shoe.

The outsole 14 as shown in FIG. 3 includes traction pads 24 to prevent slipping. The traction pads 24 may be of a different or the same design as shown in the present embodiment or may be gently sloping knobs as depicted in FIGS. 4 and 8. One characteristic of the ideal traction pads 24, besides that they insure stability of walking during wet conditions, is that they are spaced well enough apart so as to not allow the attraction of mud or debris between the raised areas.

Figure 5:
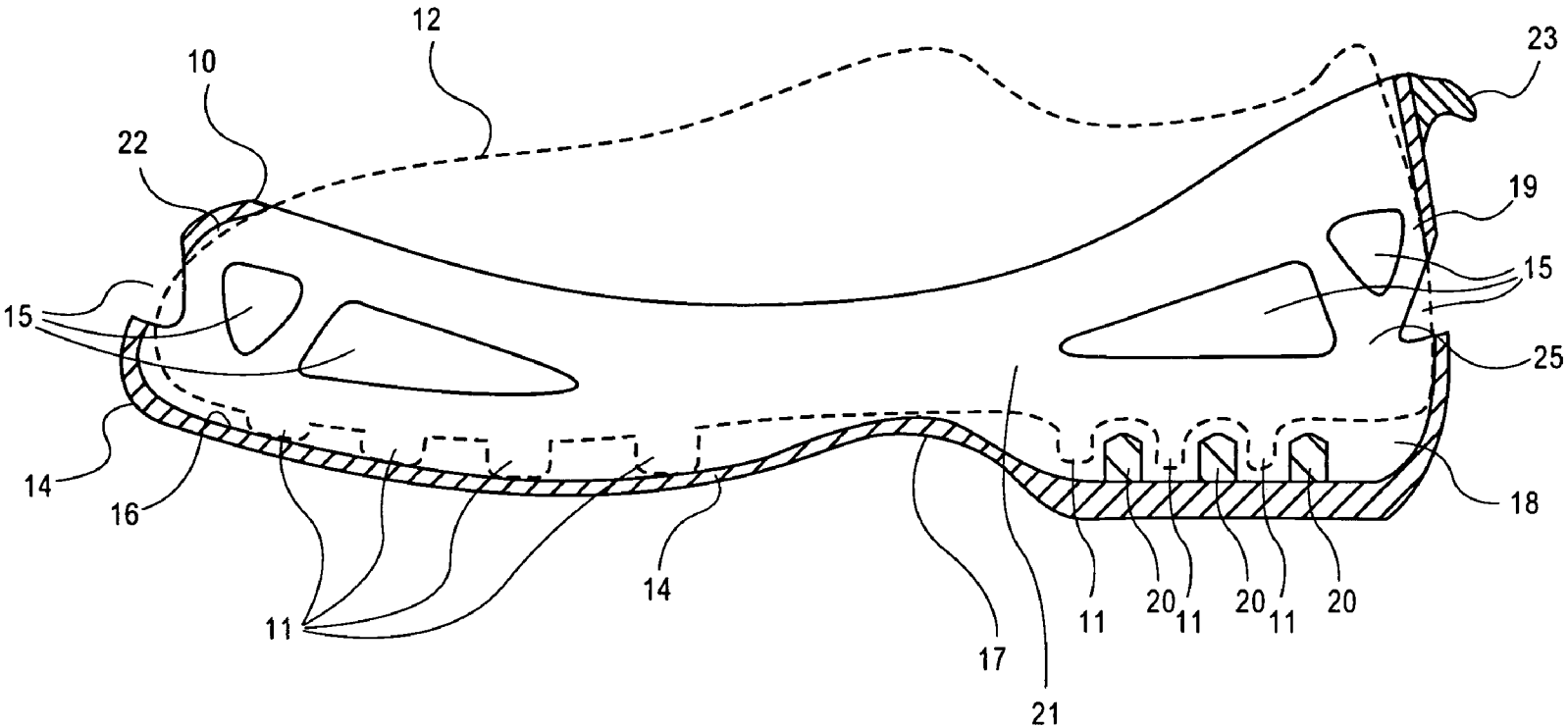

FIG. 5 depicts the donned overshoe 10 from the left side in a cross-sectional view. In this figure it can be seen that the outsole 14 is attached to and integral with a low profile upper 22. A spike or cleat 11 is engaging sole socket 16 and heel socket 18 with sloping side walls and spaced ventilation grips 15. Note in this view it appears that the cleats are aligned with the bosses 20 when in a preferred embodiment the center line of the cleats and bosses are parallel, not aligned. The upper 22 slopes down from the quarter 19 to the shank 17 and rises minimally to rest slightly above the toe of the cleated shoe 12 as also seen in FIG. 8. The upper is minimized to allow the cleated shoe 12 to fit easily into and be removed from said overshoe 10 and to allow the user to untie the laces and remove the cleated shoe 12 for storage while the overshoe 10 remains in place, thus affording the user the ability to don the cleated shoe 12 anywhere, without concern for ruination of said cleats 11 or the external environment.

Figure 6:
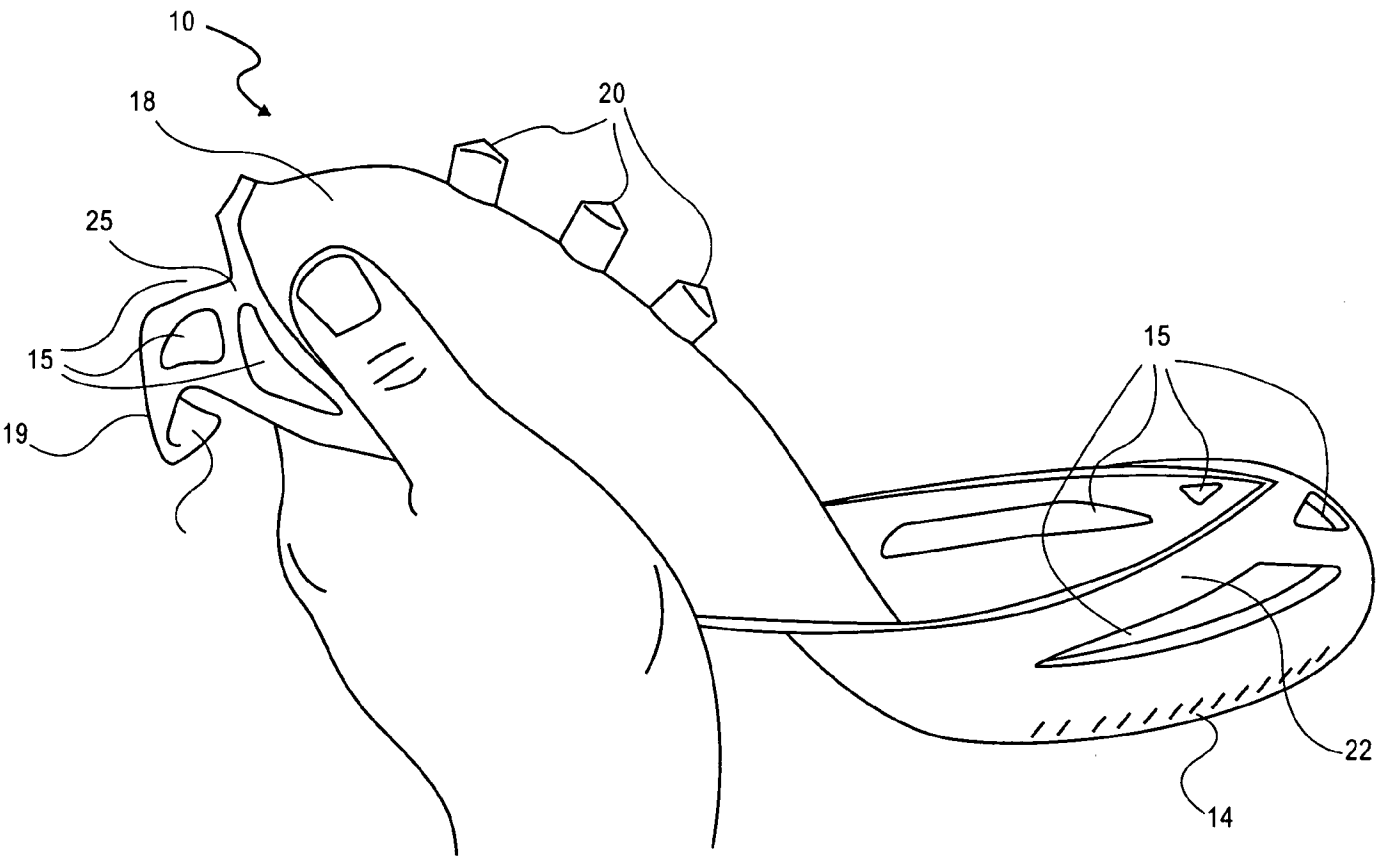
FIG. 6 illustrates the overshoe of FIG. 1 with the bosses extending above the insole and the upper peeled-back to a non-interfering position relative to the bosses. In this position the bosses are used for cleaning.
Figure 7:
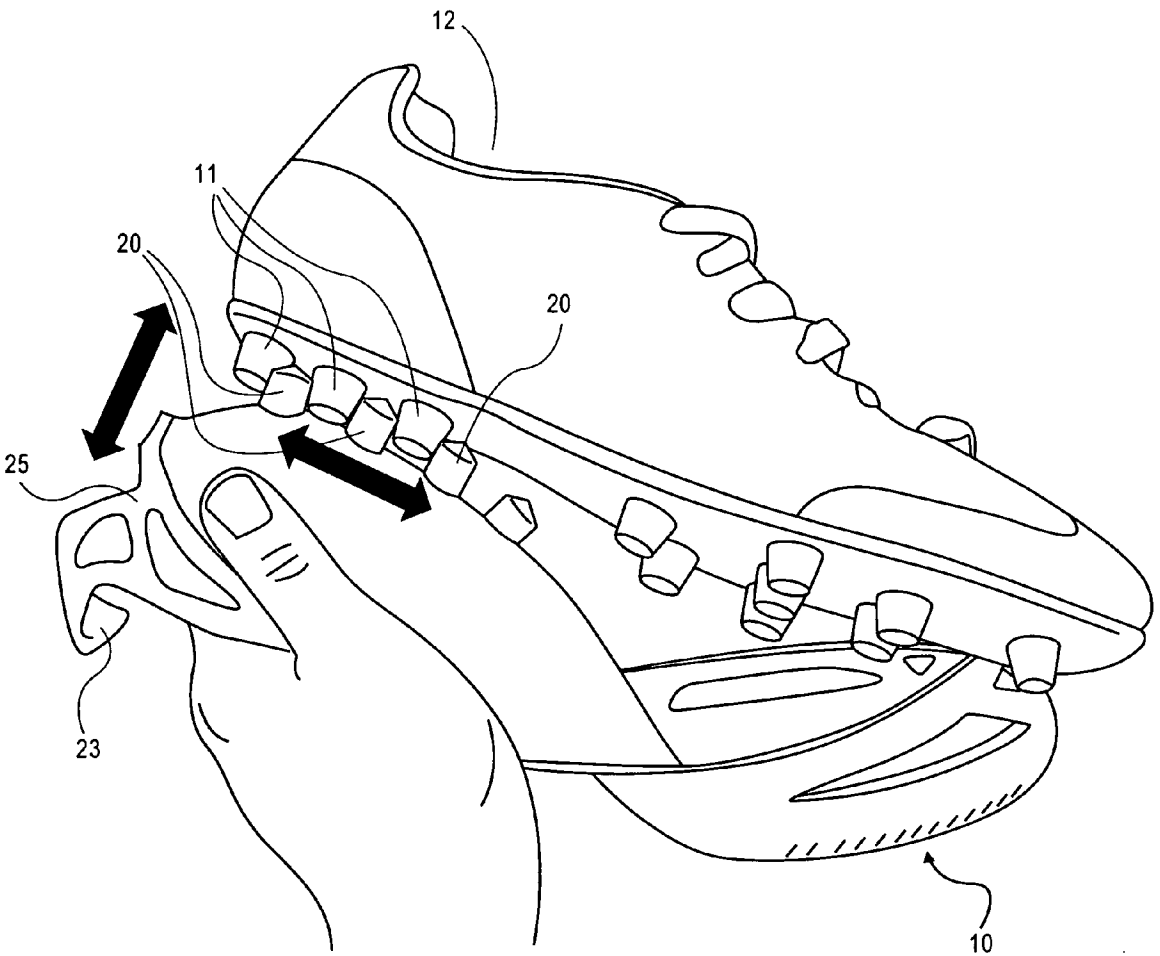
FIG. 7 illustrates the overshoe from FIG. 6 being used to clean the bottom and cleats on the athletic shoe.

Referring again to FIG. 1, in this embodiment there are five ventilation grips 15 in the forward area of the upper 21 at the toe section 22 and five ventilation grips 15 in the rear of said upper 21 at upper heel section or quarter 19. The rounded, triangular design and placement of the ventilation grips 15 serve several functions. First, the ventilation grips 15 provide air holes to allow the leather of the covered cleated athletic shoe 12 to dry properly. The overshoe, thus, may be used to store the athletic shoe. Second, the ventilation grips 15 are rounded to prevent tearing while providing finger holes for gripping and pulling, thereby acting as gripping aids for donning and removal of the overshoe 10. Third, the ventilation grips 15 in the quarter 19 of this embodiment as seen in FIG. 4 are designed as interlocking rounded triangular cutaways that result in two inversion cuffs 25 that, allow the heel socket 18 to be easily inverted for access to the cleaning bosses 20 as shown in FIGS. 6 and 7. Fourth, including these numerous cutaways or ventilation grips 15 reduces material costs. Lastly, because there are ample numbers of the ventilation grips 15 to allow airflow, some of the holes can be adorned with plastic inserts, similar to those currently made for Crocs brand shoes, but perhaps in sport logos and other associated themes.

Referring again to the drawings, a hook-shaped cleaning boss 23 is shown at the quarter 19 of the overshoe 10. This cleaning boss 23 is provided to enhance the usability of the overshoe 10 by providing an additional way to clean the cleats 11. Boss 23 may be used in an overshoe with and without the bosses 20. There may be areas of the soiled and muddied cleated shoe 12 that require another type of cleaning tool that has a different shape to aid in the cleat cleaning process. In one embodiment, the alternate cleaning boss 23 is sharply shaped like a pick and is integrated into the outer frame of the overshoe in order to allow accessibility without inversion by grasping the entire quarter 19 from the rear and using the alternative cleaning boss 23 to pick or scrape out the mud and debris between the soiled cleated shoe 12 prior to or after donning said overshoe 10.

Figure 9:
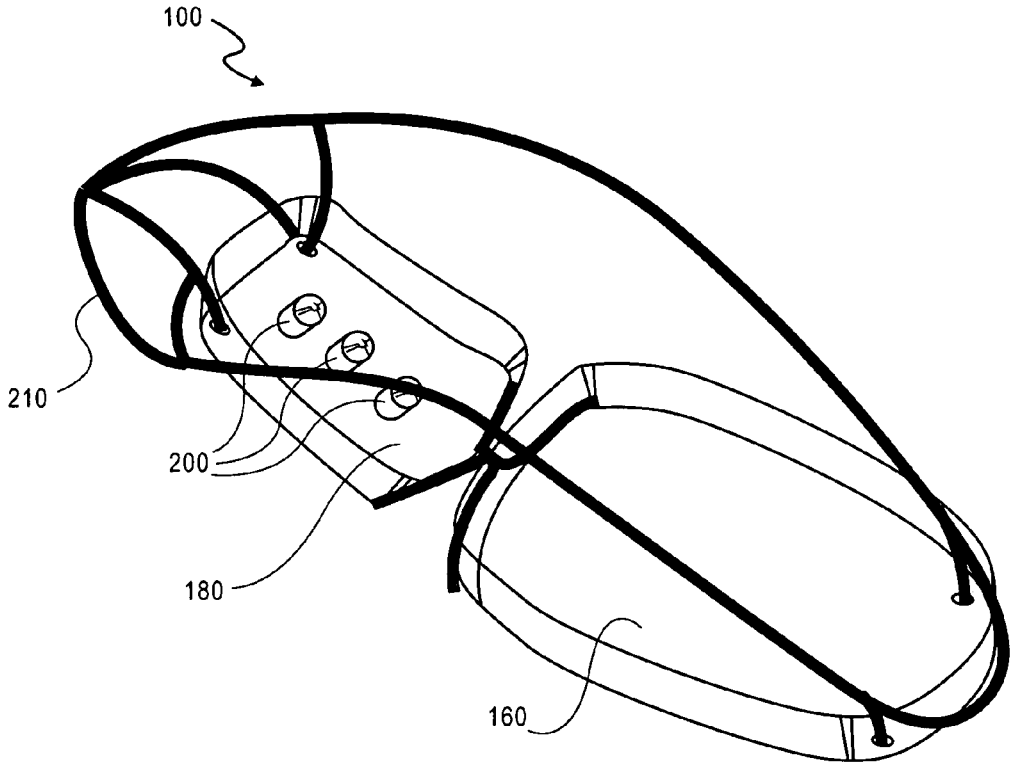
FIG. 9 is an alternate embodiment of the overshoe in a sandal-like configuration.

An alternate embodiment with a sandal-like overshoe is shown in FIG. 9. The overshoe 100 includes a heel section 180 and a sole section 160. Each of the sections may be fabricated from a flexible material such as commonly used for sandals. Bosses 200 extend upwardly from the sole section 160 and correspond to the bosses 20 previously described. An upper 210 formed from an elastic material, again such as commonly used with sandals, allows the overshoe 100 to engage an athletic shoe.

The overshoe 100 may be made in separate pieces and then assembled or as one integral member, which may be molded as a flat member.

Thus, an overshoe has been described with integral cleaning tools for cleaning athletic shoes or the like.

What is claimed is:

1. An overshoe for engaging an athletic shoe having a bottom with cleats comprising:

a sole having an outsole and insole;

an upper connected with the sole for allowing the overshoe to engage the athletic shoe;

a plurality of bosses extending upward only on a center line of the insole at a heel section such that the bosses can be used to clean the bottom of the athletic shoe, the sole and upper being flexible so as to allow a boss to be manipulated between cleats on the overshoe.

2. The overshoe of claim 1, wherein the sole and upper are a single molded member.

3. The overshoe of claim 2, including vent openings in the upper.

4. The overshoe of claim 1 or 3 including a hook-shaped or pick-shaped protrusion extending outwardly from the upper at the heel region, the protrusion to facilitate cleaning the athletic shoe.

5. An overshoe for engaging an athletic shoe having cleats extending from the athletic shoe's bottom, comprising:

a lower portion having an interior and exterior, heel, shank and toe sections of a generally flexible material and a plurality of upright protrusions extending from the interior heel section consisting of upright protrusions formed in a straight line;

an upright portion of a generally flexible material extending upright from the heel and shank sections for engaging the sides of the athletic shoe; and an upper toe section connected to the lower portion defining a toe cup for receiving a toe portion of the athletic shoe;

wherein the protrusions can be brought to an extended position when the upright portion is rolled back from an original position toward the exterior shank and heel sections thereby allowing the protrusions to be used to scrape clean the athletic shoe's bottom and cleats.

6. The overshoe of claim 5, wherein the upright portion includes openings that make it more flexible when rolled back and when returned to its original position.

7. The overshoe of claim 6, wherein the entire overshoe is a single molded member.

8. The overshoe of claim 7, wherein the shank section is of a thinner thickness than either the toe or heel sections.

9. The overshoe of claim 8, including a hook-shaped or pick-shaped protrusion extending from the upright portion above the heel section, away from the interior of the heel section, the protrusion being useful as a cleaning tool.

10. In an overshoe for engaging an athletic shoe, an improvement comprising:

a plurality of interior facing bosses extending upward from only a center line of a heel section of the overshoe interior, the overshoe being flexible so as to allow the bosses to be brought to a position where it can clean the overshoe.

11. The improvement of claim 10, wherein the bosses have a diameter of approximately 1 cm.

12. The improvement of claim 10, including vents in the overshoe to allow drying.

* * * * *